United States Patent [19]

Jensen et al.

[11] 4,407,340

[45] Oct. 4, 1983

[54] CONTAINER PRESSURIZATION SYSTEM

[75] Inventors: Eric L. Jensen; Harry W. Lee, Jr., both of Richmond, Va.

[73] Assignee: Reynolds Metals Company, Richmond, Va.

[21] Appl. No.: 362,671

[22] Filed: Mar. 29, 1982

Related U.S. Application Data

[63] Continuation-in-part of Ser. No. 217,773, Dec. 18, 1980, abandoned.

[51] Int. Cl.[3] ..... B65B 31/00

[52] U.S. Cl. ..... 141/67; 141/82; 141/159; 222/69

[58] Field of Search ..... 53/79, 88, 510; 141/4, 141/5, 9, 48, 63, 64, 67, 69, 70, 82, 140, 141, 157, 159, 392; 222/69, 640, 641

[56] References Cited

U.S. PATENT DOCUMENTS

| | | | |
|---|---|---|---|
| 1,361,498 | 12/1920 | Ruff | 141/5 X |
| 2,949,941 | 8/1960 | Mojonnier | 141/141 |
| 2,964,918 | 12/1960 | Hansen et al. | 141/4 X |

FOREIGN PATENT DOCUMENTS

| | | | |
|---|---|---|---|
| 1455652 | 11/1976 | United Kingdom | 53/403 |

*Primary Examiner*—Stephen Marcus
*Assistant Examiner*—Mark Thronson
*Attorney, Agent, or Firm*—Alan T. McDonald

[57] ABSTRACT

An apparatus is disclosed for pressurizing containers by injecting predetermined amounts of liquified gas into the containers. This device includes an injection unit having a combination float-pressure regulating means which employs the vapor pressure of evaporating liquified gas to its gaseous state from its liquid state to control liquified gas level and gas pressure within the device.

8 Claims, 5 Drawing Figures

CONTAINER PRESSURIZATION SYSTEM

CROSS-REFERENCE TO RELATED APPLICATIONS

This is a continutation-in-part of U.S. application Ser. No. 217,773, filed Dec. 18, 1980, now abandoned.

BACKGROUND OF THE INVENTION

Numerous products, such as soft drinks and beer, are packaged in containers under pressure. The pressure under which these products are packaged results from the carbonation within the product, i.e., the sealed container is pressurized due to the nature of the product within the container.

Some containers, notably two-piece aluminum and steel cans, are designed with the minimum side wall thickness possible, to reduce the amount of metal required to form the container and thus to reduce the cost of the container. These containers, as well as such other containers as plastic bottles and the like, rely heavily upon the internal pressure of the product within the container to increase the burst strength and overall wall strength of the container.

Whether the carbonated products be packaged within a can, bottle or other container, air is removed from the headspace above the product in the container prior to sealing of the closure onto the container, due to the carbon dioxide released by the product. Removal of this air from the headspace above the product within the container is desired to help prevent spoilage of the product due to air.

Recently, it has become increasingly popular to package non-carbonated products, such as fruit drinks and the like, in the same containers which have been employed in the past only for carbonated products. However, since these products are still, i.e., they do not develop internal pressure due to carbonation after sealing of the container, these products cannot be relied upon to add structural strength to a filled metallic container, plastic bottle, and other similar containers, nor can these products be relied upon to remove air from the headspace above the product prior to sealing of the container by means of a closure element.

It is known to physically mix gaseous nitrogen into such still products prior to packaging thereof, in order to provide nitrogen gas for both pressurization of the container and to remove air from the headspace above the container just prior to sealing. However, nitrogen gas does not mix easily with these products, and thus this process is a rather time consuming and expensive one.

It is also known from British Pat. No. 1,455,652 that container bodies filled with still products could be pressurized by placing drops of liquid nitrogen or a liquified noble gas into the filled container, followed by immediate sealing of the container. After sealing, the evaporating liquified gas, now in its gaseous form, would pressurize the container body.

Unfortunately, the British patent illustrates no complete apparatus for accomplishing this result. One apparatus for accomplishing this result was proposed in U.S. application Ser. No. 38,011, filed May 10, 1979, now abandoned. Control of the liquified gas level was difficult in this apparatus, and freeze-up, due to moisture entering the apparatus, was a continual problem.

THE PRESENT INVENTION

The present invention provides an apparatus for injecting liquid nitrogen or other liquified gas, such as noble gases, including argon and the like, into containers which overcomes the deficiencies of prior attempts. The injection system of the present invention includes a liquid holding chamber, a means for permitting selected amounts of liquified gas to be injected into containers as they pass the device and a combination float-valve means for maintaining liquid levels and gaseous pressure levels within the device. The apparatus also includes means for maintaining a gaseous atmosphere around the exit nozzle, thus prohibiting air and moisture from entering the device, freezing, and thus causing failure of the device.

BRIEF DESCRIPTION OF THE DRAWINGS

The liquified gas injection system of the present invention will be more fully described with reference to the drawings in which.

DETAILED DESCRIPTION OF THE PREFERRED EMBODIMENT

Figure 1:
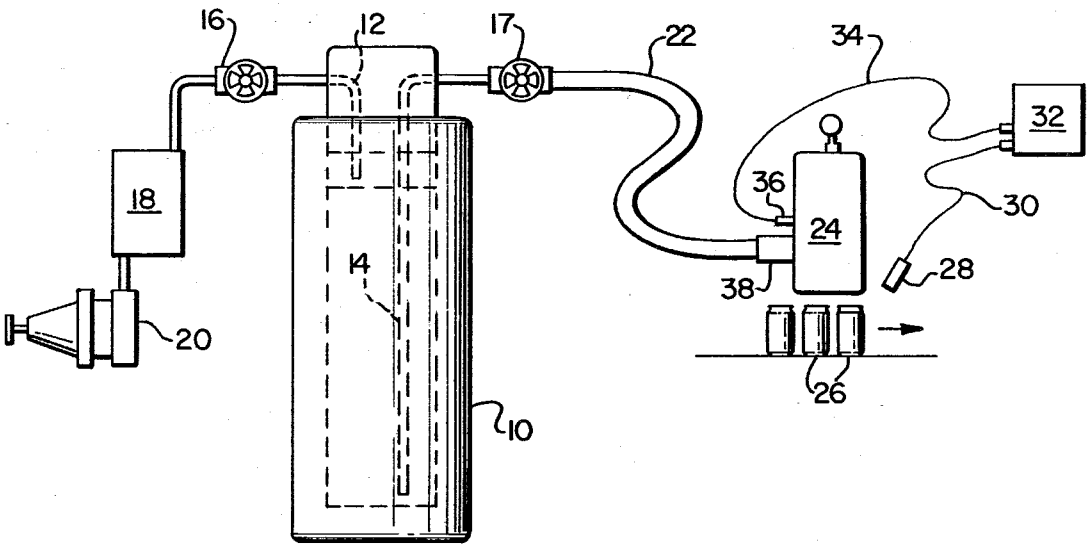
FIG. 1 is a diagramatic representation of the liquified gas injection system of the present invention.

Turning to the FIGURES, a schematic representation of a liquid nitrogen injection system is illustrated in FIG. 1. While specific reference is made to liquid nitrogen, it is understood that other liquified gases compatible with the product being packaged, such as noble gases, notably argon, could be used instead. A tank 10 is the source of liquid nitrogen for the system. Such tanks 10 are commercially available and include pressure release mechanisms (not shown) so that the gas pressure of evaporating liquid nitrogen within the tank 10 will not exceed the strength of the tank 10. Positioned within the tank 10 are a pair of tubes 12 and 14. Tube 12 is positioned above the liquid nitrogen within the tank 10 and is employed to control the pressure of the evaporating gaseous nitrogen within the tank 10 above the liquid nitrogen to the operable levels for the system. Thus, line 12 includes a valve 16, a heater 18 to heat the gaseous nitrogen, which may be supplied through the line 12 at a temperature of about −200° F. (−129.1° C.), and a back pressure controller 20. Back pressure controller 20 is set at a pressure equal to that desired within the system, which may range from about to 3 to 5 pounds per square inch (2109.3 to 3515.5 kilograms per square meter) guage, and preferably about 4 pounds per square inch (2812.4 kilograms per square meter) guage. This pressure is far lower than the pressure which can be handled by the tank 10 and which is thus controlled by its internal pressure release mechanisms. The purpose of the heater 18 is to prevent freezing of the back pressure regulator 20 and failure of this unit.

Line 14 is positioned within the liquid nitrogen itself. Liquid nitrogen is "pumped" through this line by the internal pressure within tank 10. Valve 17 controls liquified gas flow from line 14 to insulated line 22. Line 22 is preferably formed from a metal pipe which is covered with foam rubber or other insulation material to reduce heat loss as much as possible. Line 22 is connected at its other end to liquified gas intake 38 of an injector unit 24.

Passing under the injector 24 are container bodies, such as metallic cans 26. Passing of these containers under unit 24 is detected by detector 28 and a signal is given through line 30 to a controller 32. Controller 32 relays this message through line 34 and electrical connector 36 to the injector 24, and the injector 24 injects a controlled amount of liquid nitrogen into the container 26. This operation will be described in more detail below.

Figure 2:
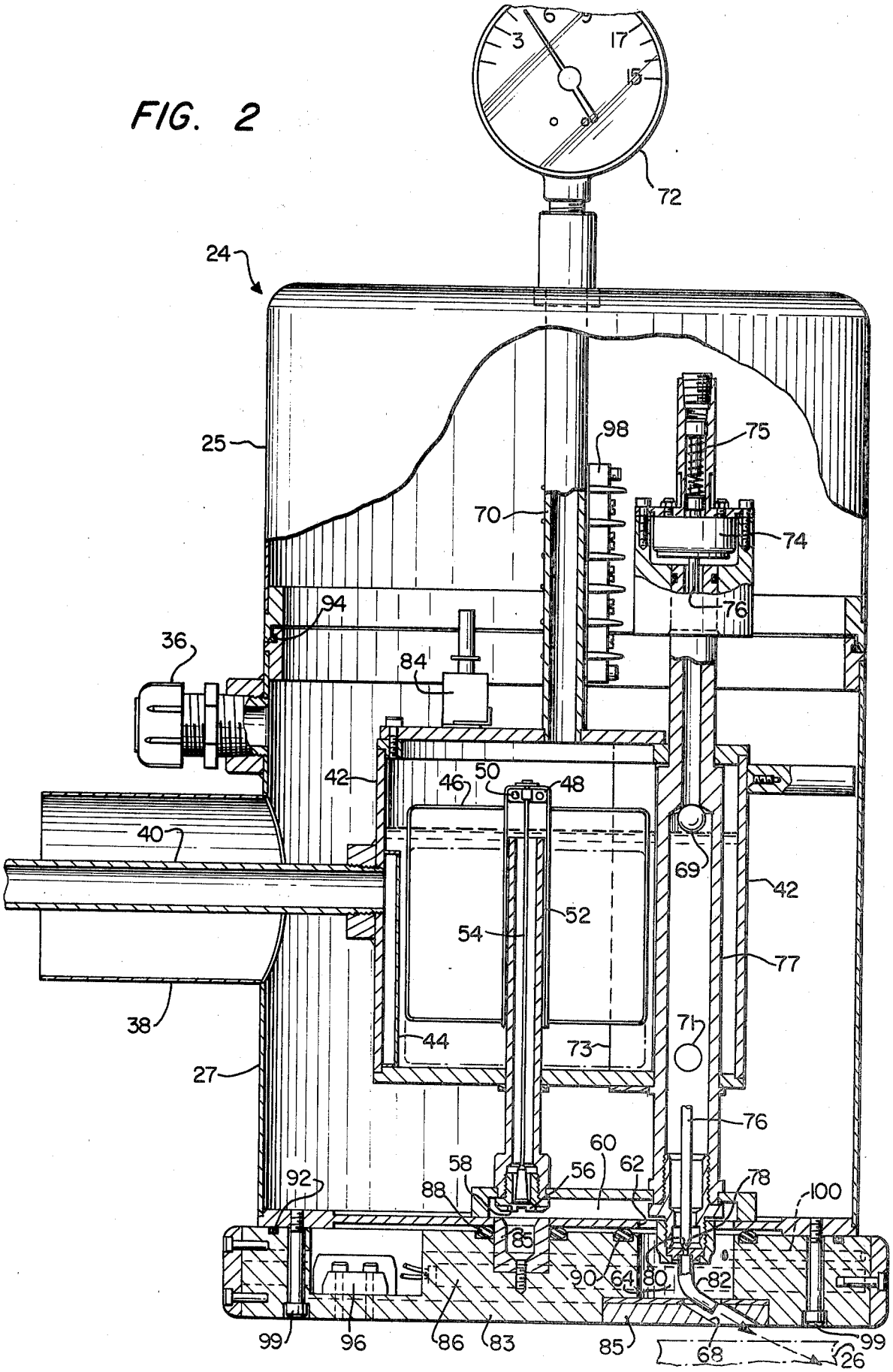
FIG. 2 is a cross-section view of the injection unit.
Figure 3:
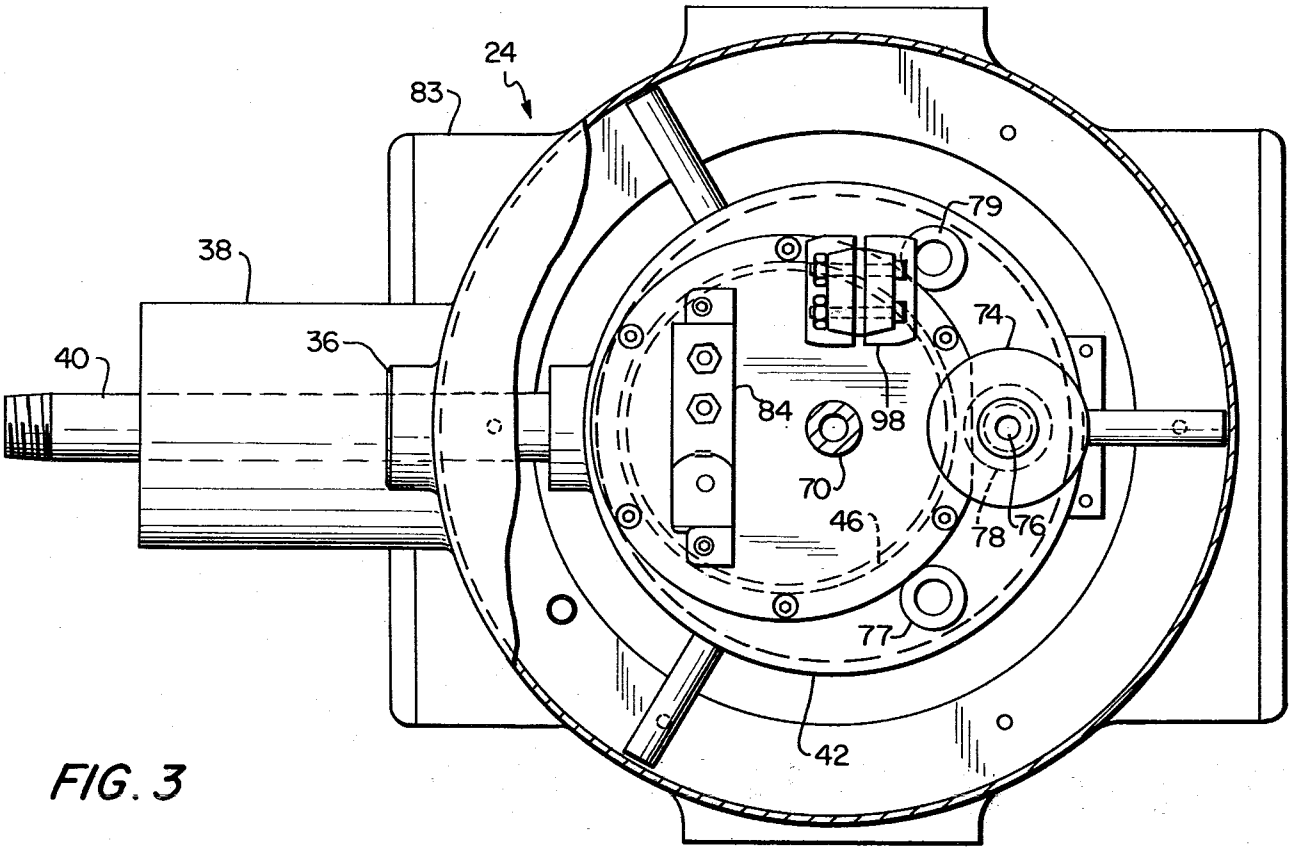
FIG. 3 is a top view of the injection unit.

FIGS. 2 and 3 illustrate the injection unit 24. Intake line 40 is surrounded by an insulated covering member 38. The intake line 40 ends with its connection to a fluid chamber 42. Fluid chamber 42 has located therein a float 46, which float 46 rises and falls with the level of liquid nitrogen within the chamber 42. A baffle 44 is provided at the entrance to chamber 42, to prevent direct impingement of entering liquified gas against float 46 and disruption of its operation.

During start-up, float 46 will rest upon the bottom of the chamber 42. At start-up, the temperature of the injector device 24, as well as intake lines 22 and 40, are far in excess of the boiling point of liquid nitrogen. Thus, initially, almost, if not all, of the nitrogen entering chamber 42 will be in gaseous form. This gas is vented through a valving mechanism which includes a valve 56 seated within valve seat 85 when open, a stem 54 and a cap 48, all attached to float 46. The cap 48 includes a plurality of openings 50 through which the gas may enter. The gas passes through a tube 52 over which float 46 travels, through a valve seat 58, along a chamber 60, through opening 62, through another chamber 64 and out exit 68. This action cools the internal parts of the unit 24 and flushes the system with nitrogen, eliminating any air from the system and thus helping to prevent later moisture freeze-up.

As the unit 24 cools, more and more liquid nitrogen enters through line 40. At this point, float 46 rises. Still, some liquid nitrogen will boil off as a gas, maintaining a pressure above float 46, which is measured through line 70 connected to chamber 42 and pressure meter 72 attached to line 70.

During the rise of float 46, valve 56 is still open, permitting some of the liquid nitrogen to vaporize and escape through valve seat 58 and through the exit system previously mentioned, where it will eventually exit as a gas. Eventually, equilibrium will be obtained, where valve 56 is slightly opened or closed within valve seat 58, with the entering of additional liquid nitrogen through line 40 tending to make float 46 rise and increases in the gas pressure above float 46 tending to make float 46 sink.

The injection of liquid nitrogen from unit 24 into containers 26 is controlled by a needle valve 78 located within valve seat 80. As detector 28 detects the presence of a container 26, controller 32 signals solenoid 74. When solenoid 74 closes, it pulls valve stem 76 upwardly, causing liquid nitrogen to pass from tube 77, which tube 77 is in fluid flow relation with the chamber 42 through fluid openings 69 and 71, to permit liquid nitrogen to pass out from valve seat 80 and through exit line 82 to the container body 26. Solenoid 74 is a high speed, magnetic solenoid, capable of opening and closing at rates exceeding 3,000 strokes per minute. This is more than sufficient to accommodate any container filling line, the fastest of which rarely exceed 1,500 units per minute.

The amount of time which solenoid 74 permits valve 78 to remain open is timed by controller 32. Thus, a trigger signal from sensor 28 starts a timer within unit 32 to activate solenoid 74 and deactivate it according to a pre-set time span. When solenoid 74 is deactivated, spring 75 pushes valve stem 76 downwardly, closing needle valve 78 into valve seat 80 and ending the liquid nitrogen flow.

As previously mentioned, as float 46 rises and falls, gaseous nitrogen will exit valve seat 58 and pass eventually to chamber 64 and out exit 68. As can best be seen in FIG. 4, a plurality of heaters 86 located within bottom plate 83 maintain a temperature sufficiently above the temperature of the liquid nitrogen to insure that it is in gaseous form as it exits through exit 68 along with the liquid nitrogen being injected through exit line 82. This maintains a gaseous nitrogen atmosphere surrounding exit line 82 and thus prohibits air from entering this region, thus preventing freeze-up of the exit line 82. These heaters 86 also provide a temperature for the bottom plate 83 sufficiently above the freezing point of the product within container 26, such that any product which might splash onto bottom plate 83 will not freeze thereon.

Figure 4:
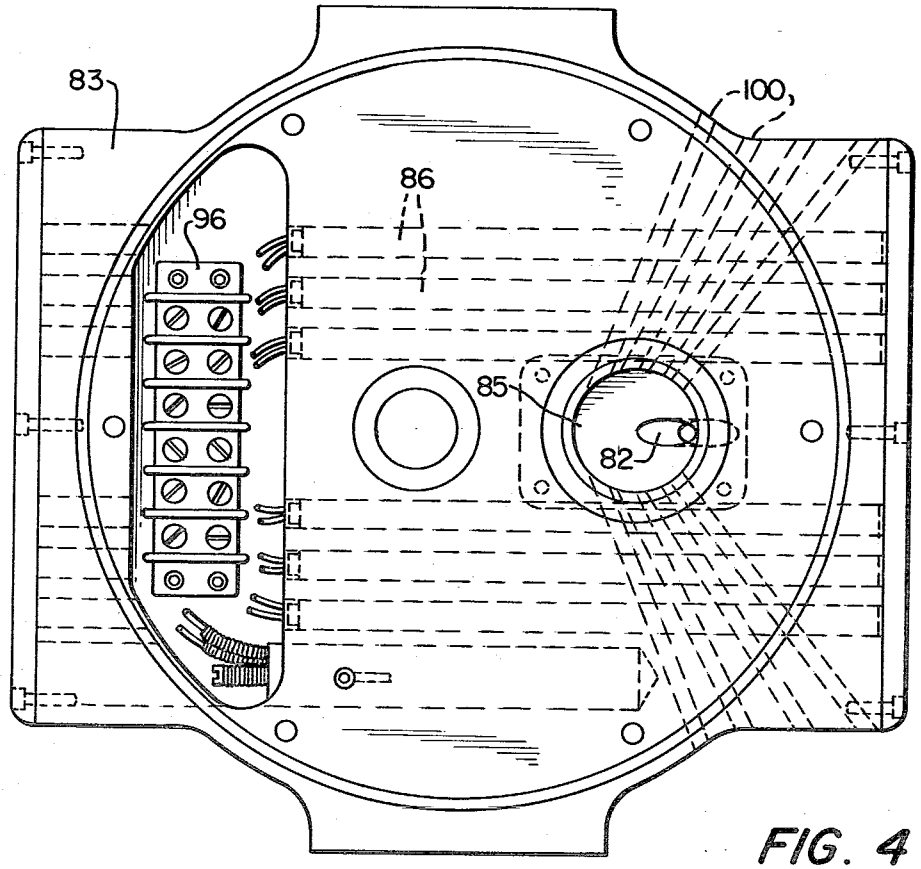
FIG. 4 is a top view of the bottom plate of the injection unit.

Looking again at FIG. 4, additional gas exit holes 100 are positioned surrounding exit line 82. These are additional positions where gaseous nitrogen can exit from chamber 64. An insert plate 85 may be rotated to change the position of exit from the injector 24 through exit line 82. Exit line 82 may be positioned at an angle ranging from about 10° to 30° with respect to the bottom of the unit 24, and an angle of about 20° is preferred.

Twelve ounce (355 milliliter) aluminum can bodies may be pressurized with an injection of about 0.1 to 0.2 milliliter of liquid nitrogen per can. The amount of liquid nitrogen injected is, of course, controlled by the length of time valve 78 is permitted to remain open and by the speed of the container 26 passing under injection unit 24.

Figure 5:
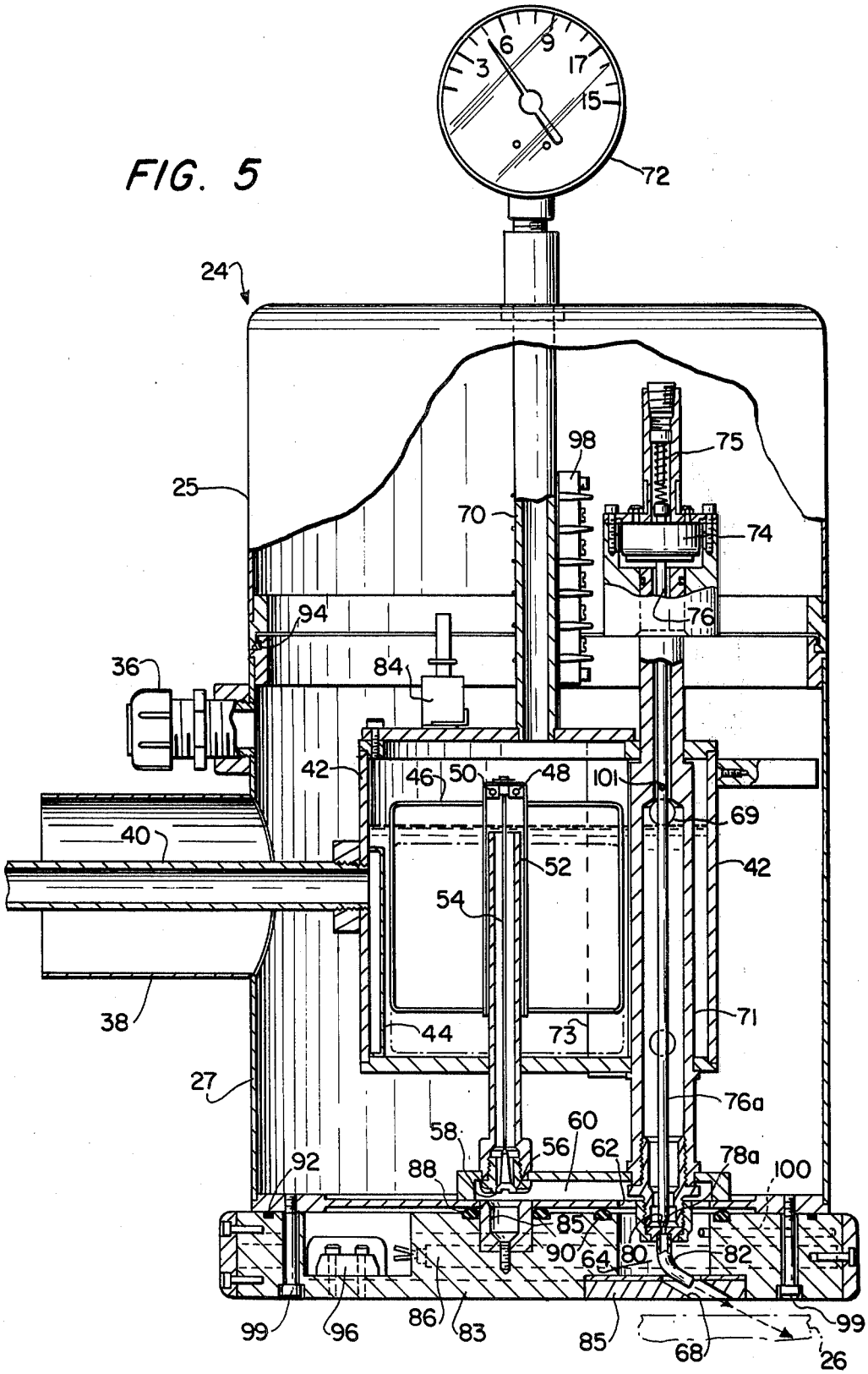
FIG. 5 is a cross-sectional view of the injection unit, illustrating a modified release valve stem.

In FIG. 5 a modified valve stem **76*a* is illustrated. In this modification, the valve stem 76*a* is in the form of a hollow tube, open at its end 78*a* and including an opening 101 which is in gas flow relation with the chamber 42**.

At the higher operating speeds, the flow of liquid nitrogen changes from clearly definable pulses to a modulated continuous flow. With this modification, the gas pressure within chamber 42 is employed at opening **78*a* of valve stem 76*a* to push the liquid nitrogen out of the exit line 82**, retaining the clearly defined pulses at the higher operating speeds.

After completion of a run, the unit 24 may be shut down temporarily. However, should air enter the unit, and, at the same time, moisture condense therein, freeze-up can occur, causing difficulty in restarting. Thus, heaters 73, controlled by thermostat 84, may be activated during shutdown and deactivated during start-up.

The major components of the unit 24 are housed within a pair of jackets 25 and 27, which are sealed by means of O-ring 94 at their juncture. Bottom plate 83 is attached to the bottom of jacket O-rings 88, 90 and 92.

Electrical connections, such as for the heaters 86 and solenoid 74, are made through a pair of terminal blocks 96 and 98, which are in turn connected to electrical connector 36, which is electrically connected to controller 32 by line 34.

Jackets 25 and 27 may be filled with insulation, such as foam polyurethane and the like, to help exclude external heat from the system during operation and thus reduce the amount of nitrogen evaporating off in gaseous form.

From the foregoing, it is clear that the present invention provides a dispensing unit for pressurizing containers with a liquified gas which maintains proper liquified gas level, balance between gaseous and liquified gas, and which prevents freeze-up of the unit during operation.

While the invention has been described with reference to certain specific embodiments thereof, it is not intended to be so limited thereby, except as set forth in the accompanying claims.

We claim:

1. Apparatus for pressurizing containers comprising a source of liquified gas, means for adjusting pressure within said liquified gas source, means for detecting said containers and injector means responsive to said detecting means to supply liquified gas to said containers, said injector means comprising an intake line in fluid flow relation with said liquified gas source, a chamber in fluid flow relation with said intake line, a float positioned within said chamber, a tube over which said float rides and in fluid flow relation with said chamber, a first valve having a valve stem connected to said float and connected in fluid flow relation to said chamber through said tube, a second valve in fluid flow relation with said chamber for releasing said liquified gas into said containers and means for controlling said second valve.

2. The apparatus of claim 1 further comprising timing means for controlling the amount of liquified gas supplied to said containers.

3. The apparatus of claim 1 further comprising heater means positioned between said liquified gas source and said pressure adjustment means.

4. The apparatus of claim 1 wherein said float includes a cap having openings therein to permit escape of gas from said chamber.

5. The apparatus of claim 1 wherein said means for controlling said second valve comprises a solenoid and a spring.

6. The apparatus of claim 1 further comprising heater means positioned within a bottom plate of said injector means for preventing freezing of said injector means during operation thereof.

7. The apparatus of claim 1 further comprising heater means positioned within said injector means for preventing moisture build-up when said apparatus is not in operation.

8. The apparatus of claim 1 wherein said second valve includes a valve stem which is in the form of a hollow tube and which is in fluid flow relation with said chamber.

* * * * *